US007629754B2

(12) United States Patent
Kim et al.

(10) Patent No.: US 7,629,754 B2
(45) Date of Patent: Dec. 8, 2009

(54) DEFLECTION YOKE FOR CATHODE RAY TUBE

(75) Inventors: Do-Nyun Kim, Suwon-si (KR); Ran-Ji Lee, Suwon-si (KR); Je-Wook Nam, Suwon-si (KR); Chang-Ryon Byon, Suwon-si (KR); Hoo-Deuk Kim, Suwon-si (KR); Moon-Jin Kim, Suwon-si (KR); Sang-Hoon Lee, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 531 days.

(21) Appl. No.: 11/348,738

(22) Filed: Feb. 6, 2006

(65) Prior Publication Data

US 2006/0181229 A1 Aug. 17, 2006

(30) Foreign Application Priority Data

Feb. 16, 2005 (KR) ..... 10-2005-0012655

(51) Int. Cl.
*G09G 1/04* (2006.01)

(52) U.S. Cl. ..... 315/370; 315/368.28

(58) Field of Classification Search ..... 315/3, 315/5, 35, 370, 399, 5.24, 5.26, 5.34, 364, 315/368.25–368.28; 313/421, 440, 442
See application file for complete search history.

(56) References Cited

U.S. PATENT DOCUMENTS 4,795,946 A * 1/1989 Nishiyama ..... 315/370
5,142,205 A 8/1992 Yabase et al.
5,393,255 A * 2/1995 Hisaoka et al. ..... 445/3
6,326,745 B1 * 12/2001 Yokota ..... 315/400
6,384,546 B2 * 5/2002 Nakajima ..... 315/371
6,580,208 B2 * 6/2003 Nelle ..... 313/442
6,744,185 B2 * 6/2004 Kim ..... 313/10
6,888,325 B2 * 5/2005 Hong et al. ..... 315/370
7,061,170 B2 * 6/2006 Iwasaki ..... 313/440

(Continued)

FOREIGN PATENT DOCUMENTS

CN 1440045 9/2003
EP 0 797 235 A2 9/1997

(Continued)

OTHER PUBLICATIONS

European Search Report dated Jul. 5, 2006, for European application 06110023.6, in the name of Samsung SDI Co., Ltd. corresponding to Korean priority 10-2005-0012655.

(Continued)

*Primary Examiner*—Douglas W Owens
*Assistant Examiner*—Jimmy T Vu
(74) *Attorney, Agent, or Firm*—Christie, Parker & Hale, LLP

(57) ABSTRACT

A deflection yoke for a cathode ray tube improves assembly and productivity and enables effective control of magnetic field corrections during device processing. The deflection yoke includes a horizontal deflection coil located next to the outer circumference of a funnel to generate a horizontal magnetic field, and a vertical deflection coil installed at the outer circumference of the funnel to generate a vertical deflection magnetic field. The vertical deflection coil is insulated from the horizontal deflection coil. A ferrite core is located close to the vertical deflection coil to reduce the loss in the magnetic force generated from the horizontal and vertical deflection coils, and to enhance their magnetic efficiency. A correction unit is spaced apart from the horizontal deflection coil by a predetermined distance to correct a geometric distortion of the vertical and the horizontal deflection magnetic fields that is generated due to the vertical and horizontal deflection coils.

14 Claims, 4 Drawing Sheets

FOREIGN PATENT DOCUMENTS

| | | | |
|---|---|---|---|
| EP | 0 797 235 | A3 | 1/1998 |
| EP | 1 103 999 | A2 | 5/2001 |
| EP | 1 339 083 | A2 | 8/2003 |
| EP | 1 339 083 | A3 | 11/2003 |
| EP | 1 103 999 | A3 | 2/2004 |
| EP | 1 501 113 | A1 | 1/2005 |
| JP | 2-204947 | | 8/1990 |

OTHER PUBLICATIONS

European Search Report dated Sep. 26, 2006, for EP 06110023.6, in the name of Samsung SDI Co., Ltd.

Patent Abstracts of Japan, Publication No. 02-204947, dated Aug. 14, 1990, in the name of Shigemi Oguchi et al.

* cited by examiner

DEFLECTION YOKE FOR CATHODE RAY TUBE

CROSS-REFERENCE TO RELATED APPLICATION

This application claims priority to and the benefit of Korean Patent Application No. 10-2005-0012655 filed in the Korean Intellectual Property Office on Feb. 16, 2005, the entire content of which is incorporated herein by reference.

BACKGROUND OF THE INVENTION

1. Field of the Invention

The present invention relates to a deflection yoke for a cathode ray tube, and in particular, to a deflection yoke having a correction unit to improve the assembly and productivity thereof, and to effectively control corrections during processing.

2. Description of Related Art

Generally, a cathode ray tube includes a neck with an electron gun mounted therein, a funnel with a deflection yoke mounted on the outer circumference thereof, and a panel with a shadow mask and a phosphor film. Electron beams emitted from the electron gun are deflected by a deflection magnetic field generated from the deflection yoke. The deflected electron beams pass through the shadow mask with a color selection function colliding against the phosphor film and emitting light to display desired images.

A horizontal deflection coil is mounted on the outer circumference of the funnel, and a vertical deflection coil is provided external to the horizontal deflection coil. A core (ferrite core) covers the vertical deflection coil. A horizontal deflection electric current is flowed through the horizontal deflection coil to generate a horizontal deflection magnetic field, and a vertical deflection electric current is flowed through the vertical deflection coil to generate a vertical deflection magnetic field.

The electron beams emitted from the electron gun directly proceed toward the phosphor film due to the attractive force of the positive electrode voltage, and enter into the region where the deflection magnetic field generated from the deflection yoke exists. Then, the electron beams are deflected due to the deflection electric current upon receipt of the force according to Fleming's left-hand rule from the deflection magnetic field, and are scanned on the phosphor screen, thereby displaying the desired images.

With the operation of uniform horizontal and vertical deflection magnetic fields, the area (space) in which the electron beams are passing through is roughly formed in a shape of a pyramid. The apex of the pyramid corresponds to the deflection center of the deflection yoke, and a geometric distortion GD called a pincushion is made at the cross point of the surface of the screen with a large curvature radius and the pyramid. The horizontal deflection magnetic field generated due to the horizontal deflection coil causes formation of a pincushion type of magnetic field, and the vertical deflection magnetic field generated due to the vertical deflection coil causes formation of a barrel type of magnetic field. In this regard, a north-south (NS) pincushion distortion and an east-west (EW) pincushion distortion are caused due to those deflection magnetic fields.

The geometric distortion GD is also caused by the difference in the left and right magnetic fields due to the relative distribution of the left and right vertical deflection coils and the dimension of the relative amount of current.

Particularly with the conventional cathode ray tube, as the screen is increased in size and flattened, the distortion from the deflection point increases toward the periphery of the screen. When the electron beams are deflected, the deflection at the farthest four corners is increased so that the NS pincushion distortion is mainly caused in the north-south direction of the screen. Furthermore, as the screen is increased in size, flattened, and made to have a higher definition, a raster distortion, an east-west (EW) pincushion distortion, and an inner distortion are produced.

When the geometric distortion GD is produced in various manners, the picture on the screen becomes twisted.

In order to correct the geometric distortions, a GD correction unit is conventionally mounted in the case or chassis of a TV set or a monitor set.

However, when the GD correction unit is mounted in the case or chassis, it is spaced apart from the location of the deflection yoke (the outer circumference of the funnel), and hence, the desired correction effect is not obtained satisfactorily.

Furthermore, in the manufacturing process, it is impossible to control the amount of correction of the GD correction unit before assembling the case or chassis. Accordingly, if the units are defective, the resulting loss is substantial. Therefore, the correction should be made before the completion of assembly to reduce the resulting loss.

SUMMARY OF THE INVENTION

The present invention provides a deflection yoke for a cathode ray tube. The deflection yoke has a correction unit and improves assembly and productivity to effectively control the correction during processing.

The deflection yoke for the cathode ray tube includes a horizontal deflection coil located next to the outer circumference of a funnel to generate a horizontal deflection magnetic field, and a vertical deflection coil installed at the outer circumference of the funnel to generate a vertical deflection magnetic field. The vertical deflection coil is insulated from the horizontal deflection coil. A ferrite core is located next to the vertical deflection coil to reduce the loss of magnetic force generated from the horizontal and the vertical deflection coils, and to enhance the magnetic efficiency. A correction unit is spaced apart from the horizontal deflection coil by a predetermined distance to correct geometric distortion of the vertical and the horizontal deflection magnetic fields.

The correction unit may be formed with a permanent magnet or an electromagnet.

The geometric distortions corrected by the correction unit include an NS pincushion distortion, a ½ NS pincushion distortion, an EW pincushion distortion, and a ½ EW pincushion distortion.

In one embodiment, where the correction unit is formed with an electromagnet magnet, a first power supply for driving the correction unit is provided independently of a second power supply for driving the vertical and the horizontal deflection coils. In one embodiment, the driving voltage applied to the correction unit is maintained at 300V or less.

BRIEF DESCRIPTION OF THE DRAWINGS

The above and other advantages of the present invention will become more apparent by describing embodiments thereof in detail with reference to the accompanying drawings, in which.

DETAILED DESCRIPTION OF PREFERRED EMBODIMENTS

Figure 1:
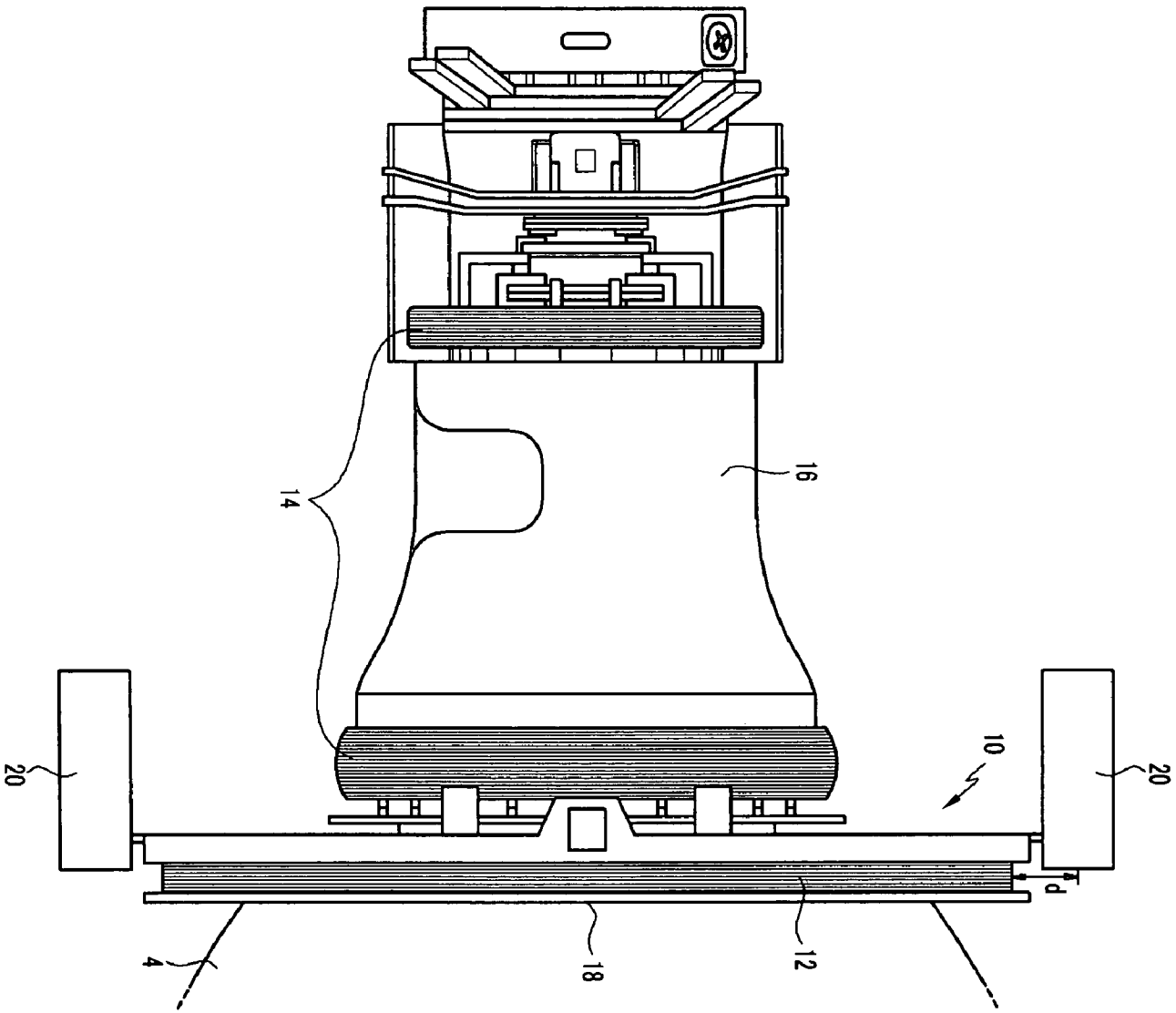
FIG. 1 is a side view of a deflection yoke for a cathode ray tube according to an embodiment of the present invention.
Figure 2:
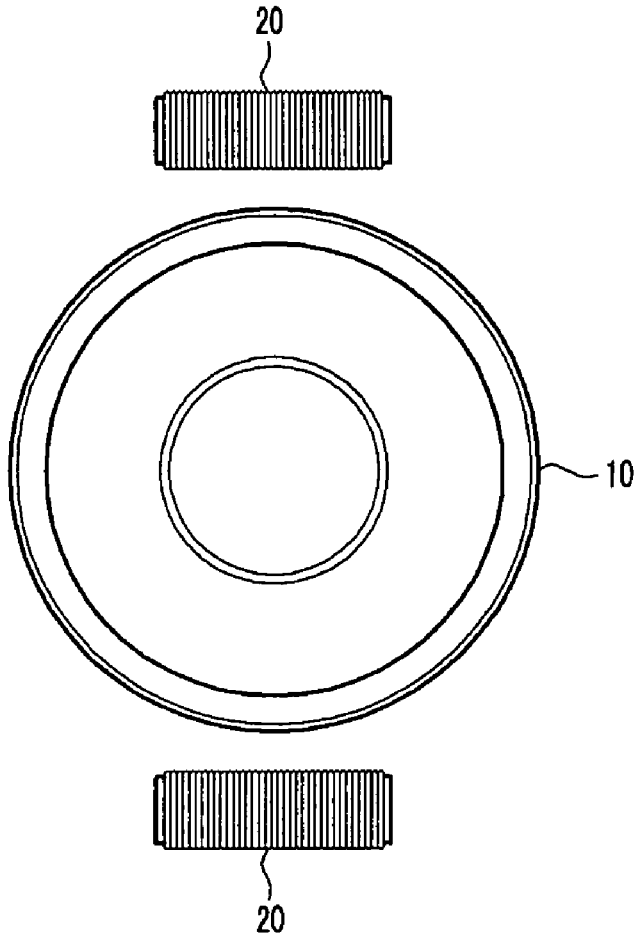
FIG. 2 is a front view of the deflection yoke for the cathode ray tube according to an embodiment of the present invention.

FIGS. 1 and 2 illustrate a deflection yoke for a cathode ray tube according to an embodiment of the present invention. As shown in FIGS. 1 and 2, the deflection yoke includes a horizontal deflection coil 12 located close (next) to the outer circumference of the funnel 4 to generate a horizontal deflection magnetic field, and a vertical deflection coil 14 provided on the outer circumference of the funnel 4 to generate a vertical deflection magnetic field. The vertical deflection coil 14 is insulated from the horizontal deflection coil 12. A ferrite core 16 is located close to the vertical deflection coil 14 to reduce a loss of the magnetic force generated due to the horizontal and the vertical deflection coils 12 and 14, and enhance the magnetic efficiency. A correction unit 20 is spaced apart from the horizontal deflection coil 12 by a predetermined distance d to correct a geometric distortion in the vertical and the horizontal magnetic fields generated due to the vertical and the horizontal deflection coils 14 and 12.

The vertical and the horizontal deflection coils 14 and 12 are insulated from each other via a separator 18 including an insulating material, such as synthetic resin.

The correction unit 20 is fitted to one side portion of the separator 18. In one embodiment, a space or structure is formed at the separator 18 to accommodate the correction unit 20.

The geometric distortions corrected by the correction unit 20 may include an NS pincushion distortion, a ½ NS pincushion distortion, an EW pincushion distortion, and a ½ EW pincushion distortion.

The correction unit 20 may be formed with a permanent magnet, or as shown in FIG. 2, with an electromagnet magnet.

When the correction unit 20 is formed with an electromagnet magnet, the power supply for driving the correction unit 20 may be formed independently of the power supply for driving the vertical and the horizontal deflection coils 14 and 12 to separately control the vertical and the horizontal deflection coils 14 and 12, and properly correct the magnetic fields thereof.

The driving voltage of the correction unit 20 is fed from a circuit installed at the case or chassis of a TV or monitor.

Figure 3:
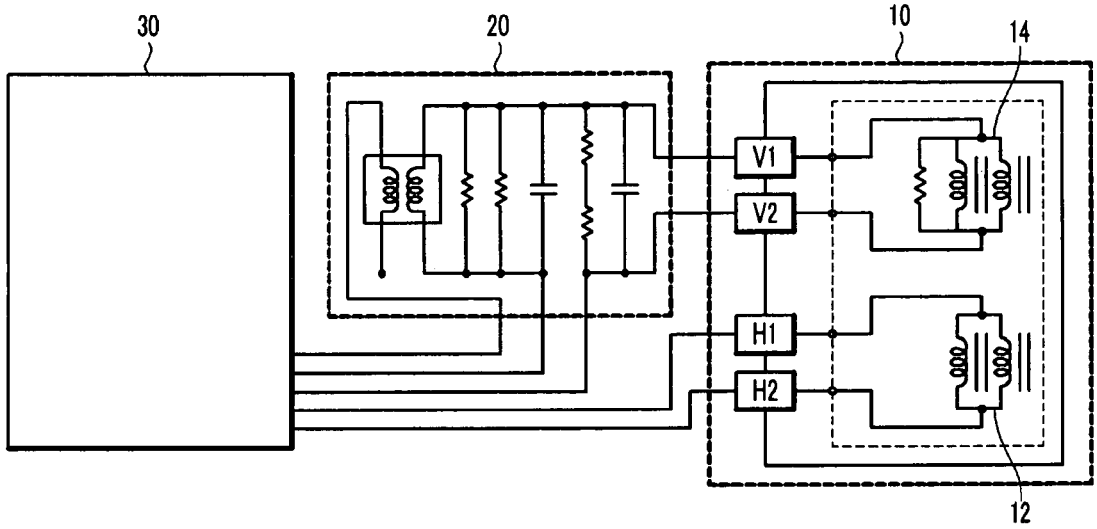
FIG. 3 is a diagram of a circuit for applying a driving voltage to a deflection yoke according to an embodiment of the present invention.

That is, as shown in FIG. 3, the correction unit 20 receives the driving voltage from a flyback transformer (FBT) 30 installed at the chassis of the TV or monitor. FBT 30 also applies voltages to the vertical and the horizontal deflection coils 14 and 12 through input terminals V1, V2, H1 and H2. Moreover, the driving voltage applied to the correction unit 20 is independent of the voltages applied to the vertical and the horizontal deflection coils 14 and 12.

The driving voltage of the correction unit 20 is maintained at 300V or less to correct the geometric distortion without adversely influencing the magnetic fields of the vertical and the horizontal deflection coils 14 and 12.

As described above, the driving voltage of 300V or less is constantly applied to the correction unit 20 independently of the vertical and the horizontal deflection coils 14 and 12, and the geometric distortion is corrected without incurring any loss in the deflection sensitivity.

As shown in FIG. 2, the correction unit 20 is located at the top and bottom of the vertical and the horizontal deflection coils 14 and 12.

It is also possible to install the correction unit 20 at the left and/or right sides of the vertical deflection coil 14 and/or the horizontal deflection coil 12, or at all four sides thereof.

Figure 4:
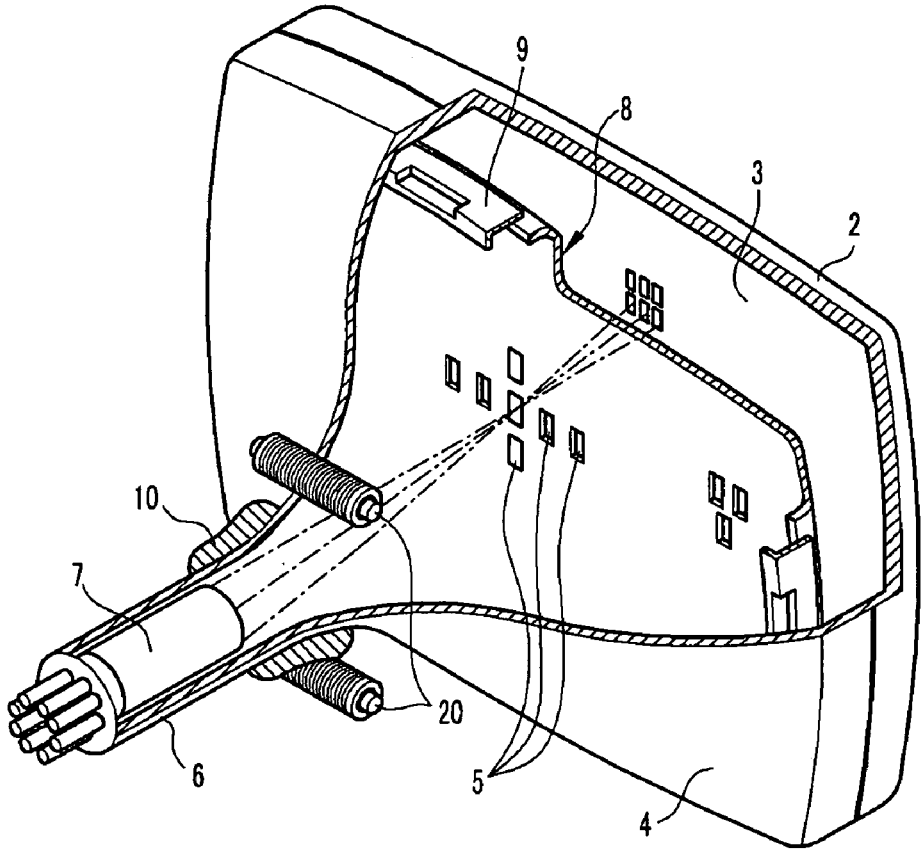
FIG. 4 is a partial sectional perspective view of a cathode ray tube with the deflection yoke according to an embodiment of the present invention.

FIG. 4 illustrates a cathode ray tube with the above-structured deflection yoke according to the embodiment of the present invention.

As shown in FIG. 4, the cathode ray tube includes a panel 2 with an inner phosphor film 3, a funnel 4 connected to the panel 2, and a neck 6 connected to the funnel 4. An electron gun 7 is mounted within the neck 6 to emit electron beams. A deflection yoke 10 mounted around the outer circumference of the funnel 4 to deflect the electron beams emitted from the electron gun 7. A shadow mask 8 is mounted within the panel 2 to color-select the electron beams emitted from the electron gun 8. A correction unit 20 is located close to the outer circumference of the deflection yoke 10 to correct the geometric distortion of the magnetic field.

The phosphor film 3 is formed on the inner surface of the panel 2 by coating red R, green G, and blue B phosphors thereon in a pattern of dots or stripes while interposing a black matrix BM. The electron gun 7 is mounted within the neck 6, and the deflection yoke 10 for deflecting the electron beams emitted from the electron gun 7 is mounted around the outer surface of the funnel 4.

The panel 2, the funnel 4, and the neck 6 are integrated into one body to thereby form a vacuum vessel. The shadow mask 8 is mounted within the panel 2 such that it is spaced apart from the phosphor film 3 by a predetermined distance, and is supported by a frame 9. A plurality of electron beam passage holes 5 are formed at the shadow mask 8.

The deflection yoke exhibits greater effects when it is used in a cathode ray tube having a wide-angled deflection angle of 110° or more (the conventional cathode ray tube has a deflection angle of 102-106°) to make it slimmer.

According to the deflection yoke of the present invention, the correction unit is located closer to the deflection yoke that generates the deflection magnetic fields, compared to the case where the GD correction unit is installed at the case or chassis. Therefore, a better correction effect can be achieved.

Furthermore, in the manufacturing process, it is possible to drive the correction unit with the mounting of the deflection yoke before assembling the case or chassis. Therefore, in the case defective units are generated, the resulting loss can be reduced, because it is not needed to disassemble the case or chassis.

As described above, according to the deflection yoke of the present invention, when a correction unit for correcting the geometric distortion of the deflection magnetic field is mounted at the deflection yoke, assembly and productivity are enhanced, and corrections during device processing are effectively controlled.

Although exemplary embodiments of the present invention have been described in detail hereinabove, it should be clearly understood that many variations and/or modifications of the basic inventive concept herein taught which may appear to those skilled in the art will still fall within the spirit and scope of the present invention, as defined in the appended claims.

What is claimed is:

1. A deflection yoke for a cathode ray tube comprising:

a horizontal deflection coil located close to an outer circumference of the funnel to generate a horizontal deflection magnetic field;

a vertical deflection coil installed at the outer circumference of the funnel to generate a vertical deflection magnetic field, the vertical deflection coil being insulated from the horizontal deflection coil;

a ferrite core located next to the vertical deflection coil to reduce a loss of magnetic force generated from the horizontal and vertical deflection coils; and a correction unit spaced apart from the horizontal deflection coil by a predetermined distance to correct a geometric distortion of the vertical and horizontal deflection magnetic fields, wherein the geometric distortions corrected by the correction unit comprise an NS pincushion distortion, a ½ NS pincushion distortion, an EW pincushion distortion, and a ½ EW pincushion distortion.

2. The deflection yoke for a cathode ray tube of claim 1, wherein the correction unit is formed with one of a permanent magnet and an electromagnet.

3. The deflection yoke for a cathode ray tube of claim 2, wherein the correction unit is formed with an electromagnet, and a first power supply for driving the correction unit, wherein the first power supply is independent of a second power supply driving the vertical and the horizontal deflection coils.

4. The deflection yoke for a cathode ray tube of claim 3, wherein a driving voltage applied to the correction unit is maintained at 300V or less.

5. The deflection yoke for a cathode ray tube of claim 2, wherein the correction unit is installed at top and bottom of the vertical deflection coil.

6. A cathode ray tube comprising:

a panel having a phosphor film on an inner surface thereof;

a funnel connected to the panel;

a neck connected to the funnel;

an electron gun mounted within the neck to emit electron beams;

a deflection yoke mounted around an outer circumference of the funnel to deflect the electron beams emitted from the electron gun, wherein the deflection yoke is insulated by a separator;

a shadow mask mounted within the panel to color-select the electron beams emitted from the electron gun; and a correction unit located next to the outer circumference of the deflection yoke and fitted to a side portion of the separator to correct a geometric distortion of a deflection magnetic field, wherein the correction unit is formed with one of a permanent maguet and an electromagnet, and wherein the geometric distortions corrected by the correction unit comprise an NS pincushion distortion, a ½ NS pincushion distortion, an EW pincushion distortion, and a ½ EW pincushion distortion.

7. The cathode ray tube of claim 6, wherein the correction unit is formed with an electromagnet, and a first power supply for driving the correction unit, wherein the first power supply is independent of a second power supply driving the deflection yoke.

8. The cathode ray tube of claim 7, wherein a driving voltage applied to the correction unit is maintained at 300V or less.

9. The cathode ray tube of claim 7, wherein the correction unit is installed at top and bottom of the deflection yoke.

10. The cathode ray tube of claim 6, wherein a deflection angle of the electron beams deflected by the deflection yoke is 110° or more.

11. A deflection yoke for a cathode ray tube having a funnel, comprising:

a horizontal deflection coil located next to an outer circumference of the funnel;

a vertical deflection coil installed at the outer circumference of the funnel, wherein the vertical deflection coil being insulated from the horizontal deflection coil by a separator;

a correction unit fitted to a side portion of the separator and spaced apart from the horizontal deflection coil to correct a geometric distortion of the vertical and horizontal deflection magnetic fields;

a first power supply for driving the correction unit; and a second power supply for driving the deflection yoke, wherein the first power supply is independent of the second power supply, wherein the geometric distortions corrected by the correction unit comprise an NS pincushion distortion, a ½ NS pincushion distortion, an EW pincushion distortion, and a ½ EW pincushion distortion.

12. The deflection yoke of claim 11, wherein the correction unit is formed with one of a permanent magnet and an electromagnet.

13. The deflection yoke of claim 11, wherein a driving voltage applied to the correction unit is maintained at 300V or less.

14. The deflection yoke of claim 12, wherein the correction unit is installed at top and bottom of the vertical deflection coil.

* * * * *